US006382914B1

(12) United States Patent
Tressler

(10) Patent No.: US 6,382,914 B1
(45) Date of Patent: May 7, 2002

(54) COOLING MEDIUM TRANSFER PASSAGEWAYS IN RADIAL COOLED TURBINE BLADES

(75) Inventor: Judd Dodge Tressler, Mason, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/792,556

(22) Filed: Feb. 23, 2001

(51) Int. Cl.[7] ..... F01D 5/18
(52) U.S. Cl. ..... 416/97 R
(58) Field of Search ..... 415/115, 116; 416/96 R, 97 R

(56) References Cited

U.S. PATENT DOCUMENTS

| | | | | |
|---|---|---|---|---|
| 3,719,431 A | | 3/1973 | Steele et al. | |
| 5,350,277 A | | 9/1994 | Jacala et al. | |
| 5,462,405 A | * | 10/1995 | Hoff et al. | 416/97 R |
| 5,482,435 A | * | 1/1996 | Dorris et al. | 416/97 R |
| 5,536,143 A | | 7/1996 | Jacala et al. | |
| 5,660,523 A | * | 8/1997 | Lee | 416/97 R |
| 5,873,695 A | | 2/1999 | Takeishi et al. | |
| 5,924,843 A | | 7/1999 | Staub et al. | |
| 6,059,529 A | | 5/2000 | Schiavo | |
| 6,065,931 A | | 5/2000 | Suenaga et al. | |
| 6,092,991 A | | 7/2000 | Tomita et al. | |

FOREIGN PATENT DOCUMENTS

| | | |
|---|---|---|
| JP | 59-231103 | 12/1984 |

* cited by examiner

*Primary Examiner*—Edward K. Look
*Assistant Examiner*—Ninh Nguyen
(74) *Attorney, Agent, or Firm*—Nixon & Vanderhye

(57) ABSTRACT

Radially extending cooling passages are provided in a turbine blade for flowing cooling air from a root portion to a tip portion of the blade. The passages are spaced from one another in a fore-to-aft direction. The aft cooling passages are smaller in diameter than the forward cooling passages. Refresher passageways extend from the larger-diameter passages to the smaller-diameter passages to supplement the cooling flow through outer portions of the aft cooling passages to cool the aft outer span portion of the blade.

14 Claims, 2 Drawing Sheets

Fig. 1
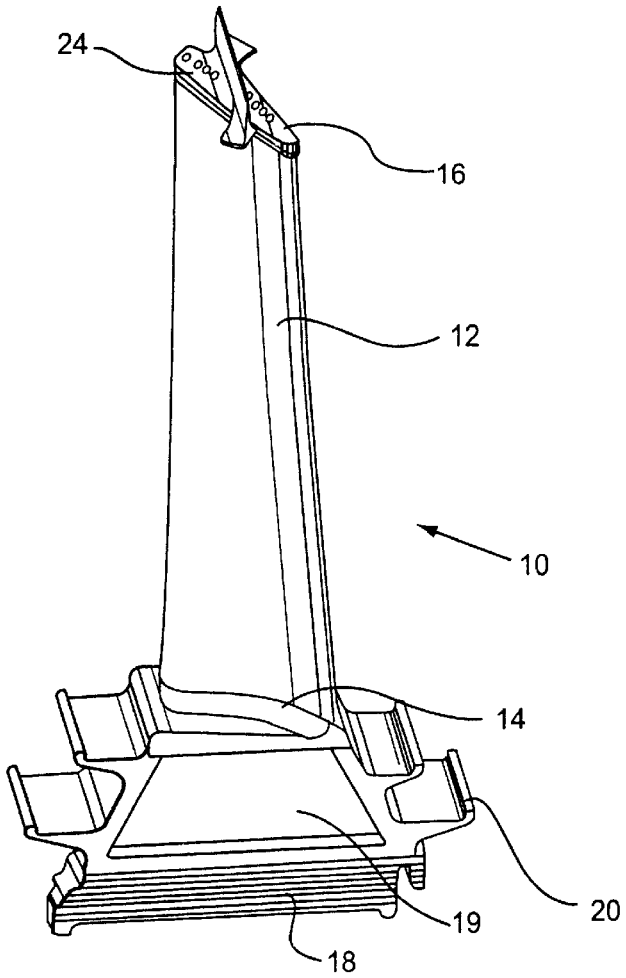
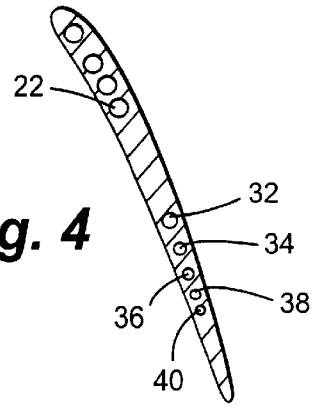
Fig. 4
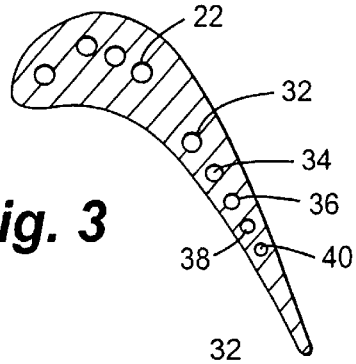
Fig. 3
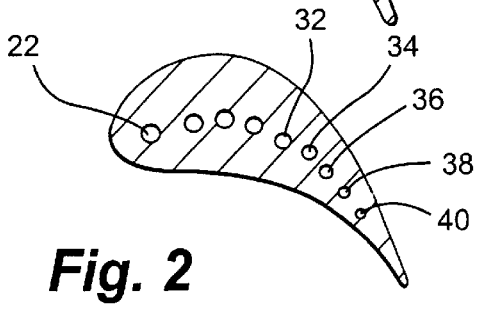
Fig. 2

COOLING MEDIUM TRANSFER PASSAGEWAYS IN RADIAL COOLED TURBINE BLADES

BACKGROUND OF THE INVENTION

The present invention relates to radial cooled turbine blades and particularly to a system for cooling aft outer span portions of the blades adjacent the trailing edges thereof.

In turbine blade designs which require limited cooling, one approach has been to form generally radially extending drilled holes through each solid cast turbine blade. Typically, compressor discharge air, serving as the cooling medium, is supplied to a plenum at the root of each blade. The cooling air then flows from the plenum generally radially outwardly along the airfoil section of the blade body through straight drilled holes toward the blade tip to cool the blade. The spent cooling air exits the blade tip into the hot gaspath. Because of the airfoil shape of the blade, however, aft portions of the blade cannot be as effectively cooled as forward portions of the blade due to the smaller diameter hole size in the aft portion of the blade necessary to maintain adequate blade wall thickness. That is, the diameters of the aft cooling passages are smaller than the diameters of the more forward cooling passages so that the blade does not encounter structural failure along its aft portions. With these reduced heat transfer surfaces, the cooling medium is rapidly heated. This rapid heat pickup reduces the capacity of the cooling medium to cool the radially outer spans of the aft portions of the blade. This results in inadequate cooling of those aft outer span portions. Consequently, there is a need for a cooling system which will adequately cool the outer aft portions of a cast turbine blade without adverse affect on the structural strength of the blade.

BRIEF SUMMARY OF THE INVENTION

In accordance with a preferred embodiment of the present invention, there is provided a cooling system for a turbine blade wherein cooling air from the adequately cooled forward cooling passages is diverted to one or more of the smaller diameter cooling passages in the outer aft portion of the blade to supplement the flow of cooling air in those latter portions. To accomplish the foregoing, one or more refresher cooling passageways are provided between forward and aft cooling passages at about the midspan portion of the blade. The cooler diverted cooling air supplements the heated cooling air in the aft cooling passages adjacent the aft outer span of the blade.

Particularly, a refresher passageway may extend from a forward cooling passage to a next-adjacent aft cooling passage of smaller diameter. A portion of the cooling air from the large-diameter cooling passage flows through the refresher passageway and combines with the cooling air flowing from the root through the smaller-diameter cooling passage. The refresher passageway communicates with the small-diameter cooling passage at a radial location along the latter passage to effectively cool its aft outer span portion. That is, the inlet to the refresher passageway from the larger-diameter cooling passage is located about midspan of the blade. The outlet from the refresher cooling passageway to the smaller-diameter cooling passage is located radially outwardly of the inlet. This facilitates a natural pumping action of the air from the root, through the cooling passages and refresher passageways to the tips, where the cooling air flows through tip openings into the hot gaspath. It will be appreciated that as the turbine blades rotate, centrifugal forces pump the air radially outwardly. Additionally, the flow of cooling medium from the blade roots to their tips through the cooling passages and refresher passageways is facilitated because high pressure compressor discharge air at the blade roots delivers air to those passages and passageways for exit to a lower pressure region at the tips of the blades. Thus, the cooler air flowing from the refresher passageways into the adjacent smaller-diameter cooling passages refreshes the latter with cooler air affording improved cooling effectiveness. That is, the temperature of the combined flow radially outwardly of the refresher passageways is lower than the temperature of air otherwise flowing through aft cooling passages at those locations without the diverted or supplement flow. As a consequence, aft outer portions of the turbine blades are effectively cooled.

In a preferred embodiment according to the present invention, there is provided a cooling system for a turbine blade comprising a turbine blade body having root and tip portions and a generally airfoil-shaped portion therebetween, a plurality of discrete cooling passages extending from the root portion along the airfoil-shaped portion and to the tip portion for flowing a cooling medium generally radially outwardly along the blade, the passages opening through the tip portion, the passages being spaced one from the other from a forward leading edge of the blade body to an aft trailing edge of the body, at least one passageway interconnecting one of the cooling passages and another of the cooling passages and located in the airfoil-shaped portion between the tip and root portions of the body, one passage and one passageway being located forwardly of another passage, the one passageway having an inlet in communication with one passage and an outlet in communication with another passage, the inlet being disposed along the one passage radially inwardly of the radial location of the outlet along another passage whereby cooling medium flows from one passage through one passageway and into radially outer portions of another passage.

In a further preferred embodiment according to the present invention, there is provided a cooling system for a turbine blade comprising a turbine blade body having root and tip portions and a generally airfoil-shaped portion therebetween, a plurality of discrete cooling passages extending from the root portion along the airfoil-shaped portion and to the tip portion for flowing a cooling medium generally radially outwardly along the blade, the passages opening through the tip portion, the passages being spaced one from the other from a forward leading edge of the body to an aft trailing edge of the body and means for diverting a portion of the cooling medium from one cooling passage for flow to a radial outer portion of another cooling passage aft of the one passage to/supplement the flow of cooling medium through the radial outer portion of another cooling passage.

BRIEF DESCRIPTION OF THE DRAWINGS

FIG. 1 is a perspective view of a radially cooled blade or bucket for a turbine;

FIGS. 2, 3 and 4 are cross-sectional views thereof taken at root, midspan and tip portions of the blade of FIG. 1 and generally about on lines 2—2, 3—3 and 4—4 in FIG. 5.

DETAILED DESCRIPTION OF THE INVENTION

Figure 5:
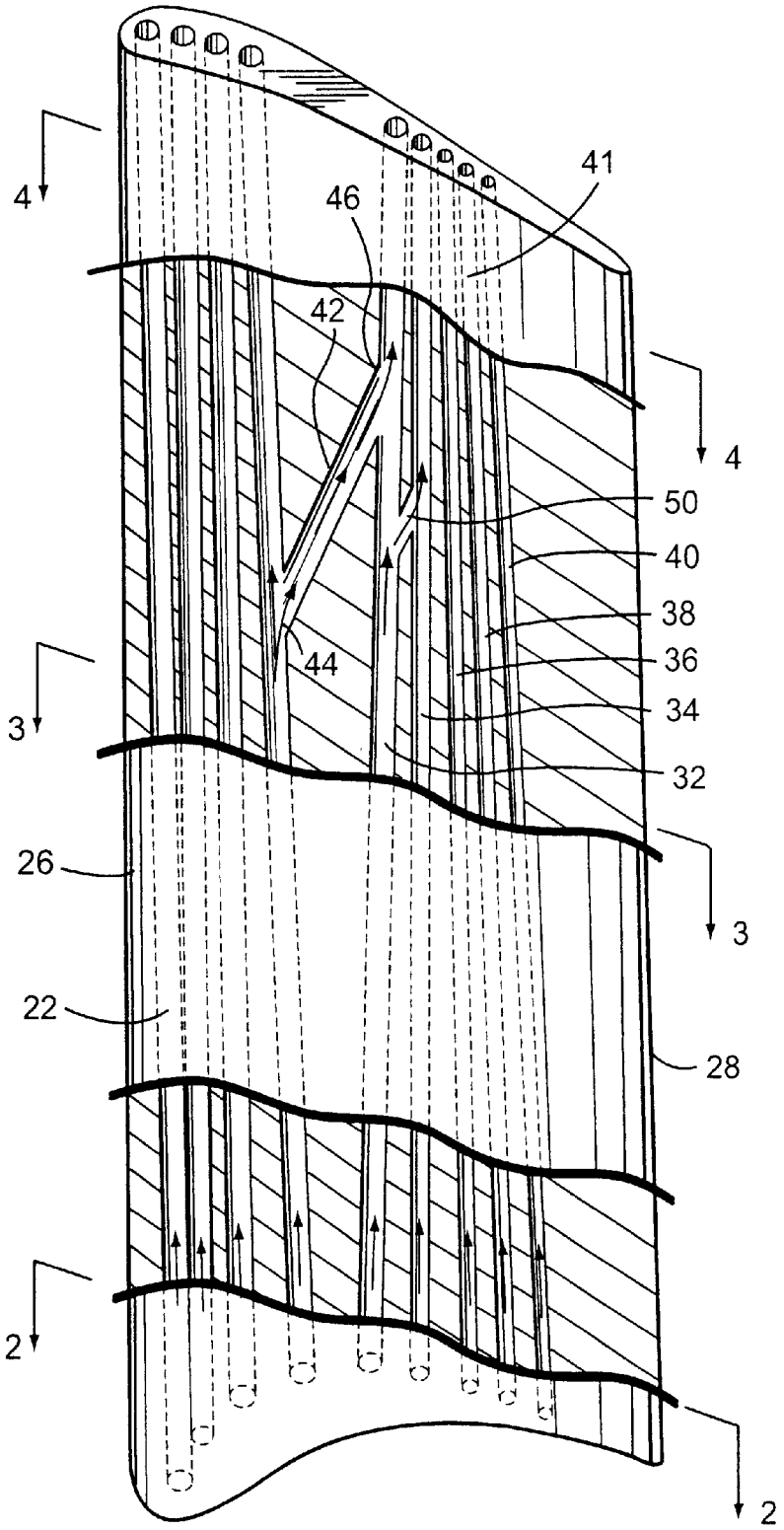
FIG. 5 is a schematic illustration of flow passages through the blade illustrating refresher passageways according to the present invention.

Referring now to the drawings, particularly to FIG. 1, there is illustrated a turbine blade, generally designated 10, having an airfoil-shaped body 12 extending from a root portion 14 to a tip 16. The root portion includes a dovetail 18 for coupling the blade to a rotor wheel of the turbine, not shown, and angel wing seals 20 for sealing with adjacent nozzle stages. The root portion 14 includes a plenum 19 for receiving a cooling medium and communicating the cooling medium, e.g., compressor discharge air, into cooling passages 22 extending from the root 14 generally radially outwardly along the airfoil-shaped blade body 12 to the tip 16. The tip 16 terminates in a tip shroud 24 having openings through which the cooling air exhausts from the blade into the hot gaspath of the turbine.

As illustrated in FIG. 5, the cooling passages 22 extend generally linearly and in a generally radial direction and are spaced one from the other from the forward leading edge 26 of the blade to its aft trailing edge 28. By forward aft is meant directionally toward the leading and trailing edges, respectively. By flowing cooling medium, i.e., pressure discharge air, through the cooling passages 22, the blade is cooled. However, because of the airfoil shape of the blade 12, the aft cooling passages, for example, passages 32, 34, 36, 38 and 40, are reduced in diameter relative to the forward cooling passages 22. The diameters of the aft passages must be reduced to maintain adequate wall thickness in aft portions of the blade. Additionally, the aft passages 32, 34, 36, 38 and 40 typically decrease in diameter relative to one another in a direction toward the trailing edge 28 as the thickness of the blade similarly decreases. Thus, the diameter of the cooling passage 32 is typically larger than the diameter of passage 34 and has a smaller diameter than forward passages 22. Likewise, the diameter of passage 34 is typically larger than the diameter of passage 36. Similarly, each aft cooling passage has a larger diameter than the next aft cooling passage in a direction toward the trailing edge 28. As discussed above, the cooling effectiveness of these passages having reduced diameters is diminished because of their increasingly smaller diameter bores which significantly adversely impacts their capacity to cool the outer span aft portions of the blade. That is, the cooling flow through the outer span aft portions 41 of the aft cooling passages may have acquired sufficient heat as to render the flow of cooling medium therethrough ineffective to cool those portions of the blade. By outer span portion 41 is meant generally the radially outer half of the blade along its length.

To improve the effectiveness of the cooling flow in the aft outer span portions of the blade, refresher passageways are provided for diverting a portion of the cooling medium flowing through a larger diameter cooling passage for flow through a smaller-diameter cooling passage and which diverted flow supplements the flow of cooling medium through the smaller-diameter cooling passage. As a consequence, the temperature of the cooling medium passing through the smaller-diameter cooling passages, e.g., along outer span aft cooling passage portions thereof is reduced, improving the effectiveness of the heat transfer at those locations and, hence, the cooling of the blade.

More particularly, a refresher passageway 42, for example, may extend from a forward cooling passage 22 to the first of the aft cooling passages 32. Particularly, the refresher passageway 42 has an inlet 44 at about the blade midspan for receiving a portion of the cooling medium flowing through the forward cooling passage 22. Another, i.e., non-diverted portion of the cooling medium in passage 22 thus continues to flow through the remaining extent of passage 22 radially outwardly of inlet 44. Passageway 42 extends both radially outwardly and in an aft direction to an outlet 46 opening into the aft cooling passage 32 in the aft outer span portion of the blade. Cooling medium diverted from the forward cooling passage 22 via inlet 44 and passageway 42 flows through the outlet 46 and combines with the cooling medium flowing from the root through the cooling passage 32 for flow through the remaining radial outer portion of passage 32 and exits the blade through the tip into the hot gaspath. Thus, the diverted cooling medium reduces the temperature of the cooling medium flowing through the cooling passage 32 along its aft outer span portion from outlet 46 to the tip 16, thereby cooling that portion of the blade. It will be appreciated that the temperature of the combined cooling medium in the aft outer portion of the passage 32 will be lower than the temperature of the cooling medium at the same locations therealong which would otherwise flow through that passage portion but for the diverted flow into passage 32.

Additional refresher passageways may be provided between other cooling passages. For example, an additional or second refresher passageway 50 may be provided between a third cooling passage, e.g., passage 32, and the next-adjacent or fourth aft cooling passage 34. The cooling medium diverted from passage 32 by second refresher passageway 50 is at a radially inward location relative to the outlet 46 of the first refresher passageway 42. Thus, the radially outward portion of cooling passage 34 receives diverted cooling medium from cooling passage 32 at a lower temperature than the temperature of the cooling medium otherwise flowing through passage 34 at that location such that the cooling medium flowing therethrough more effectively cools the aft outer span portion of the blade. Similarly, other refresher passageways may be disposed between adjacent aft cooling passages such that the overall temperature of the aft outer span portion of the blade is reduced in comparison with the blade temperature at that location without the refresher passageways.

It will also be appreciated that as the turbine blades rotate about the turbine rotor axis, the rotating centrifugal force pumps the cooling medium, e.g., air, from an inner span portion to the outer span portion. Additionally, with the lower sink pressure at the tip of the blade, the cooling air is pumped from the lower span out the tip of the blade. The flow will naturally travel from the source passage, e.g., passage 22, to the target passage, e.g., passage 32, due to the pumping action. Moreover, it will further be appreciated that the passages and/or refresher passageways need not be wholly or partially linear. Different shapes may be used, e.g., sinuous passages and/or passageways.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A cooling system for a turbine blade comprising:

a turbine blade body having root and tip portions and a generally airfoil-shaped portion therebetween;

a plurality of discrete cooling passages extending from the root portion along the airfoil-shaped portion and to the tip portion for flowing a cooling medium generally radially outwardly along the blade, said passages opening through the tip portion;

said passages being spaced one from the other from a forward leading edge of the blade body to an aft trailing edge of the body;

at least one passageway interconnecting one of said cooling passages and another of said cooling passages and located in said airfoil-shaped portion between said tip and root portions of the body, said one passage and said one passageway being located forwardly of said another passage, said one passageway having an inlet in communication with said one passage and an outlet in communication with said another passage, said inlet being disposed along said one passage radially inwardly of the radial location of said outlet along said another passage whereby cooling medium flows from said one passage through said one passageway and into radially outer portions of said another passage.

2. A blade according to claim 1 wherein said one passage has a larger flow diameter than said another passage.

3. A blade according to claim 1 wherein the one passageway is located to divert a portion of the cooling medium flowing in the one passage for flow in the passageway, the one passage continuing radially outwardly of the inlet such that another portion of the cooling medium in the one passage may flow radially outwardly of the inlet along the one passage.

4. A blade according to claim 1 wherein said one passageway is located to supplement the flow of cooling medium through said another passage through the portion of said another passage generally radially outwardly of said outlet.

5. A blade according to claim 1 wherein the passageway is located to divert a portion of the cooling medium flowing in the one passage for flow in the one passageway, the one passage continuing radially outwardly of the inlet such that another portion of the cooling medium in the one passage may flow radially outwardly of the inlet along the one passage, said one passageway being located to supplement the flow of cooling medium through said another passage through the portion of said another passage generally radially outwardly of said outlet.

6. A blade according to claim 5 wherein said one passage has a larger flow diameter than said another passage.

7. A blade according to claim 1 including a second passageway interconnecting a third cooling passage and a fourth cooling passage and located in said airfoil-shaped portion between said tip and said root portions of the body, said third passage and said second passageway being located forwardly of said fourth passage, said second passageway having an inlet in communication with said third passage and an outlet in communication with said fourth passage, said inlet to said second passageway being disposed along said third passage radially inwardly of the radial location of said outlet from said second passageway along said fourth passage.

8. A blade according to claim 7 wherein said third passage and said another passage comprise the same passage.

9. A cooling system for a turbine blade comprising:

a turbine blade body having root and tip portions and a generally airfoil-shaped portion therebetween;

a plurality of discrete cooling passages extending from the root portion along the airfoil-shaped portion and to the tip portion for flowing a cooling medium generally radially outwardly along the blade, said passages opening through the tip portion;

said passages being spaced one from the other from a forward leading edge of the body to an aft trailing edge of the body; and means for diverting a portion of the cooling medium from one cooling passage for flow to a radial outer portion of another cooling passage aft of said one passage to supplement the flow of cooling medium through the radial outer portion of said another cooling passage.

10. A blade according to claim 9 wherein said one passage has a larger flow diameter than said another passage.

11. A blade according to claim 9 wherein said diverting means diverts the cooling medium portion at a radial location along the blade body radially inwardly of said radial outer portion of said another cooling passage.

12. A blade according to claim 9 including means for diverting a portion of the cooling medium from a third cooling passage of said plurality of cooling passages for flow to a radial outer portion of a fourth cooling passage aft of the third cooling passage to supplement the flow of the cooling medium through the radial outer portion of said fourth cooling passage.

13. A blade according to claim 12 wherein said third cooling passage corresponds to said another cooling passage.

14. A blade according to claim 9 wherein said turbine blade body is cast.

* * * * *